United States Patent [19]

Jamison et al.

[11] Patent Number: 4,982,903

[45] **Date of Patent: * Jan. 8, 1991**

[54] PERISTALTIC VOLTAGE BLOCK

[75] Inventors: Chris M. Jamison; Eric A. Petersen, both of Indianapolis, Ind.

[73] Assignee: Ransburg Corporation, Indianapolis, Ind.

[ * ] Notice: The portion of the term of this patent subsequent to Nov. 7, 2006 has been disclaimed.

[21] Appl. No.: 357,851

[22] Filed: May 31, 1989

Related U.S. Application Data

[63] Continuation-in-part of Ser. No. 208,774, Jun. 17, 1988, Pat. No. 4,878,622.

[51] Int. Cl.[5] ..... B05B 5/02; F04B 43/12

[52] U.S. Cl. ..... 239/690.1; 239/708; 417/477

[58] Field of Search ..... 239/690, 690.1, 691, 239/704, 706, 708; 417/474, 476, 477; 137/565; 251/4, 6

[56] References Cited

U.S. PATENT DOCUMENTS

| | | | |
|---|---|---|---|
| 1,655,262 | 1/1928 | Fortin . | |
| 2,414,355 | 1/1947 | Bogoslowsky | 103/149 |
| 2,547,440 | 4/1951 | Clark et al. | 174/1 |
| 2,673,232 | 3/1954 | Silsby, Jr. | 174/15 |
| 3,098,890 | 7/1963 | Peterson | 174/5 |
| 3,122,320 | 2/1964 | Beck et al. | 239/3 |
| 3,138,111 | 6/1964 | Kling et al. . | |
| 3,140,666 | 7/1964 | Currie . | |
| 3,291,889 | 12/1966 | Uline et al. | 174/8 |
| 3,492,409 | 1/1970 | Williams et al. . | |
| 3,582,234 | 6/1971 | Isreeli . | |
| 3,644,068 | 2/1972 | Lepak | 417/477 |
| 3,732,042 | 5/1973 | Buchholz | 417/477 |
| 3,866,678 | 2/1975 | Jeter | 166/66 |
| 3,893,620 | 7/1975 | Rokadia | 239/3 |
| 3,899,010 | 8/1975 | Samson et al. . | |
| 3,933,285 | 1/1976 | Wiggins | 222/56 |
| 3,934,055 | 1/1976 | Tamny | 427/8 |
| 4,017,029 | 4/1977 | Walberg | 239/15 |
| 4,020,866 | 5/1977 | Wiggins | 137/592 |
| 4,085,892 | 4/1978 | Dalton | 239/15 |
| 4,159,806 | 7/1979 | Scharfenberger . | |
| 4,217,062 | 8/1980 | Trp et al. . | |
| 4,228,930 | 10/1980 | Hogan . | |
| 4,231,668 | 11/1980 | Groth et al. . | |
| 4,275,834 | 6/1981 | Spanjersberg et al. | 239/3 |
| 4,313,475 | 2/1982 | Wiggins | 141/18 |
| 4,413,788 | 11/1983 | Schaefer et al. | 239/703 |
| 4,424,011 | 1/1984 | O'Brien et al. . | |
| 4,522,571 | 6/1985 | Little . | |
| 4,530,647 | 7/1985 | Uno . | |
| 4,639,156 | 1/1987 | Stern et al. . | |
| 4,660,607 | 4/1987 | Griffith et al. . | |
| 4,660,771 | 4/1987 | Chabert et al. . | |
| 4,878,622 | 11/1989 | Jamison et al. | 239/708 |

FOREIGN PATENT DOCUMENTS

| | | |
|---|---|---|
| 891191 | 9/1953 | Fed. Rep. of Germany . |
| 973454 | 2/1960 | Fed. Rep. of Germany . |
| 2458693 | 2/1981 | France . |
| 764494 | 12/1956 | United Kingdom . |
| 1393333 | 5/1975 | United Kingdom . |
| 1478853 | 7/1977 | United Kingdom . |
| 2009486 | 6/1979 | United Kingdom . |

*Primary Examiner*—Andres Kashnikow
*Assistant Examiner*—Christopher G. Trainor
*Attorney, Agent, or Firm*—Barnes & Thornburg

[57] ABSTRACT

A coating material dispensing system includes an electrostatic high potential supply having an output terminal on which the supply maintains a high electrostatic potential, a source of coating material, a dispenser for dispensing the coating material, and appropriate fluid and electric circuits for coupling the dispenser to the source of coating material and the output terminal to the dispenser to supply potential to the coating material dispensed by the dispenser. The fluid circuit coupling the dispenser to the source of coating material includes a peristaltic voltage block having multiple coils of a resilient conduit and a rotor for supporting an element for contacting each coil at multiple contact points. The peristaltic voltage block substantially divides the flow of coating material to the dispenser into discrete slugs of coating material substantially to interrupt the electrical path through the coating material from the terminal to the coating material supply.

21 Claims, 6 Drawing Sheets

PERISTALTIC VOLTAGE BLOCK

This is a continuation-in-part of our earlier filed and co-pending U.S.S.N. 07/208,774 filed June 17, 1988, assigned to the same assignee as this application, and now U.S. Pat. No. 4,878,622.

This invention relates to electrostatically aided coating material atomization and dispensing systems and primarily to such systems which are capable of atomizing and dispensing conductive coating materials.

A problem with such systems has always been that, unless they were equipped with so-called voltage blocks, currents could flow between the electrostatic potential supply and grounded coating material supplies through the conductive coating material. Throughout this application, the term "voltage block" is used to describe both the prior art and the devices of the invention. It is to be understood, however, that these devices function to minimize, to the extent they can, the flow of current. Such current otherwise would flow from a dispensing device maintained at high electrostatic potential through the conductive coating material being dispensed thereby to the grounded source of such coating material, degrading the electrostatic potential on the dispensing device. Attempts to prevent this by isolating the coating material supply from ground result in a fairly highly charged coating material supply several thousand volts from ground. This in turn gives rise to the need for safety equipment, such as high voltage interlocks to keep personnel and grounded objects safe distances away from the ungrounded coating material supply.

Various types of voltage blocks are illustrated and described in the following listed U.S. Patents and foreign patent specifications: U.S. Pat. Nos.: 1,655,262; 2,673,232; 3,098,890; 3,291,889; 3,360,035; 4,020,866; 3,122,320; 3,893,620; 3,933,285; 3,934,055; 4,017,029; 4,275,834; 4,313,475; 4,085,892; 4,413,788; British Patent Specification No. 1,478,853; and British Patent Specification No. 1,393,313. Peristaltic pumps are known. There are, for example, the pumps illustrated and described in the following listed U.S. Patents and foreign patent specifications: British Patent Specification No. 2,009,486; British Patent Specification No. 764,494; German Patent Specification No. 891,191; German Patent Specification No. 973,454; U.S. Pat. No. 3,644,068; U.S. Pat. No. 2,414,355; U.S. Pat. No. 2,547,440; U.S. Pat. No. 3,732,042; and U.S. Pat. No. 4,522,571.

Additionally it is known to use certain types of pumps which divide fluid streams into discrete slugs of fluid to keep currents from flowing in these fluid streams. There is, for example, the system illustrated and described in U.S. Pat. No. 3,866,678.

It is an object of the present invention to provide an improved voltage block for use in electrostatically aided coating material atomization and dispensing systems.

According to the invention, a coating material dispensing system comprises an electrostatic high potential supply having an output terminal on which the supply maintains a high electrostatic potential, a source of coating material, a dispenser for dispensing the coating material, a delivery conduit for coupling the dispenser to the source of coating material, means for coupling the output terminal to the dispenser to supply potential to the coating material dispensed by the dispenser and a device for dividing the coating material in the delivery conduit into discrete slugs of coating material substantially to interrupt the electrical path through the coating material from the terminal to the coating material supply.

Illustratively, according to the invention the device comprises a peristaltic device.

Further illustratively according to an embodiment of the invention, the peristaltic device comprises a length of resilient conduit having an inlet end and an outlet end for coupling in the delivery conduit between the source of coating material and the dispenser, a housing having a wall against which the resilient conduit lies, a rotor, and means for rotatably mounting the rotor within the housing. The rotor supports means for contacting the resilient conduit. The contacting means compresses the resilient conduit against the wall of the housing substantially to separate the coating material carried thereby into slugs.

Additionally illustratively according to an embodiment of the invention, the wall is generally right circular cylindrical in configuration and the length of resilient conduit is formed into somewhat of a helix around the wall.

In addition, according to an illustrative embodiment of the invention the flexible tubing is generally flat when it is empty.

Further illustratively according to an embodiment of the invention, the wall is generally frustoconical in configuration and the length of resilient conduit is formed somewhat into a spiral wrapped around the wall.

Additionally according to an illustrative embodiment of the invention, the peristaltic pump comprises a length of flexible conduit having an inlet end and an outlet end for coupling in the delivery conduit between the source of coating material and the dispenser, a mandrel having a wall against which the resilient conduit lies, a rotor, and means for rotatably mounting the rotor to surround the mandrel. The rotor supports means for contacting the resilient conduit. The contacting means compresses the resilient conduit against the wall of the mandrel substantially to separate the coating material carried thereby into slugs.

Illustratively according to this embodiment of the invention, the wall is generally right circular cylindrical in configuration and the length of resilient conduit is formed into somewhat of a helix around the wall.

According to another aspect of the invention, a coating material dispensing system comprises an electrostatic high potential supply having an output terminal on which the supply maintains a high electrostatic potential, a source of coating material, a dispenser for dispensing the coating material, means for coupling the dispenser to the source of coating material, and means for coupling the output terminal to the dispenser to supply potential to the coating material dispensed by the dispenser. The means for coupling the dispenser to the source of coating material comprises a peristaltic voltage block for substantially dividing the flow of coating material to the dispenser into discrete slugs of coating material substantially to interrupt the electrical path through the coating material from the terminal to the coating material supply.

The invention may best be understood by referring to the following description and accompanying drawings which illustrate the invention. In the drawings.

Figure 1:
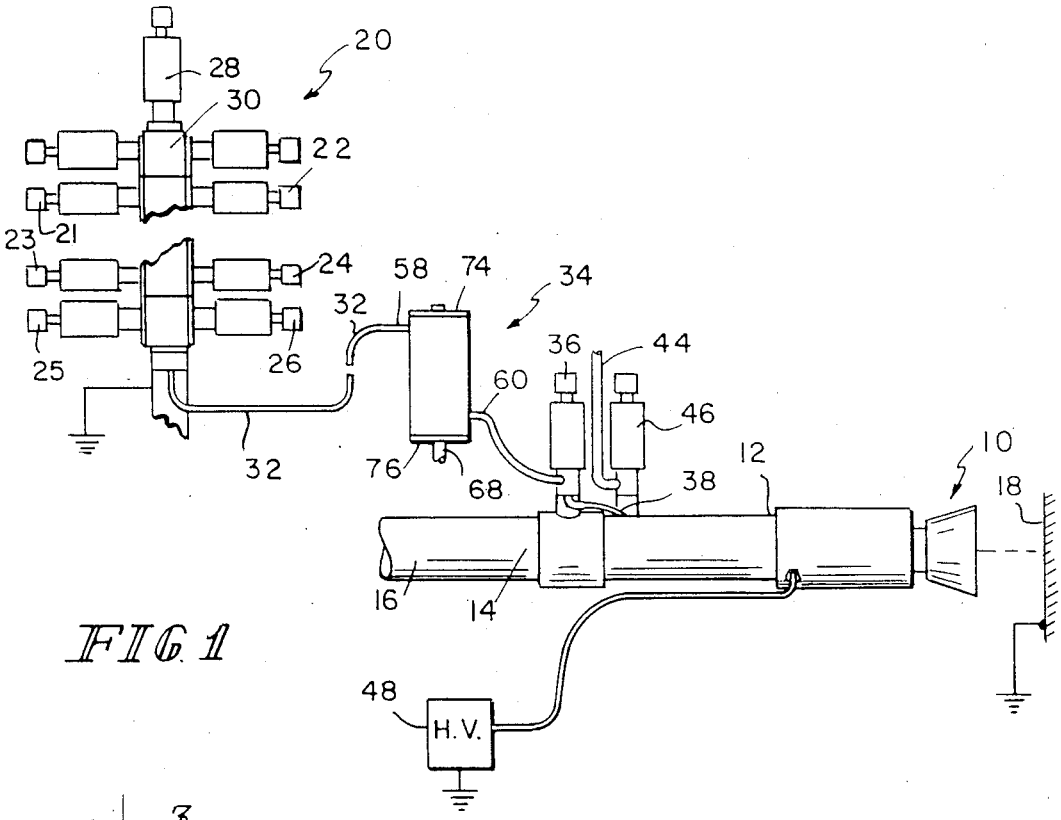
FIG. 1 illustrates a diagrammatic side elevational view of a system constructed according to the present invention.

In FIG. 1, a dispensing device 10 and some of the related electrical, liquid and pneumatic equipment for its operation are illustrated. Dispensing device 10 is mounted from one end 12 of a support 14, the other end 16 of which can be mounted to permit movement of dispensing device 10 as it dispenses coating material onto an article 18 to be coated, a "target," passing before it. Support 14 is constructed from an electrical insulator to isolate dispensing device 10 from ground potential.

The system further includes a color manifold 20, illustrated fragmentarily. Color manifold 20 includes a plurality of illustratively air operated color valves, six, 21-26 of which are shown. These color valves 21-26 control the flows of various selected colors of coating material from individual supplies (not shown) into the color manifold 20. A solvent valve 28 is located at the head 30 of color manifold 20. A supply line 32, which is also maintained at ground potential, extends from the lowermost portion of color manifold 20 through a peristaltic voltage block 34 to a triggering valve 36 mounted adjacent dispensing device 10. A feed tube 38 is attached to the output port of triggering valve 36. Feed tube 38 feeds a coating material flowing through a selected one of color valves 21-26 and manifold 20 into supply line 32, through voltage block 34, triggering valve 36, feed tube 38 and into the interior of dispensing device 10. Operation of device 10 atomizes this selected color of coating material.

For purposes of cleaning certain portions of the interior of device 10 during the color change cycle which typically follows the application of coating material to each target 18 conveyed along a grounded conveyor (not shown) past device 10, a line extends from a pressurized source (not shown) of solvent through a tube 44 and a valve 46 to device 10. Tube 44 feeds solvent into device 10 to remove any remaining amounts of the last color therefrom before dispensing of the next color begins.

The coating material dispensed by device 10 moves toward a target 18 moving along the grounded conveyor due, in part, to electric forces on the dispensed particles of the coating material. To impart charge to the particles of coating material and permit advantage to be taken of these forces, an electrostatic high potential supply 48 is coupled to device 10. Supply 48 may be any of a number of known types.

Figure 2:
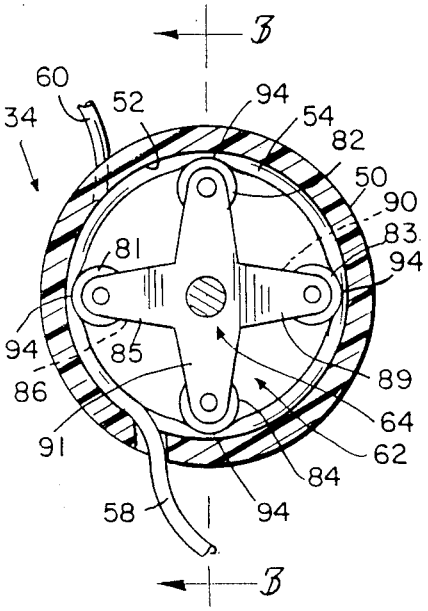
FIG. 2 illustrates a sectional end elevational view of a detail of the system of FIG. 1, taken generally along section lines 2—2 thereof.
Figure 3:
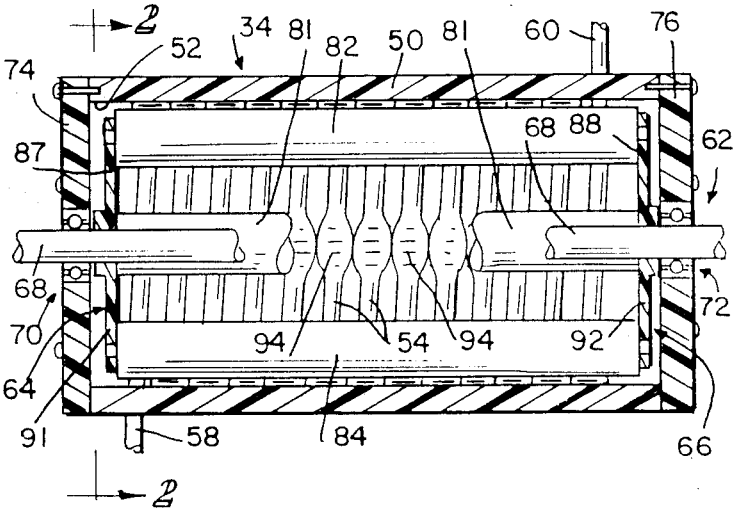
FIG. 3 illustrates a sectional side elevational view of the detail of FIG. 2, taken generally along section lines 3—3 thereof.

Turning now to FIGS. 2-3, the peristaltic voltage block 34 of the system of FIG. 1 comprises a housing 50 having a generally right circular cylindrical interior wall 52. A length 54 of soft resilient tubing is wound helically around the interior wall 52. The tubing 54 can have any suitable cross-sectional configuration, such as circular, or can be so-called "lay-flat" tubing which is flat when empty. The tubing 54 includes an inlet end 58 and an outlet end 60 for coupling the device 34 into the circuit 32, 36, 38 between the source of coating material and the device 10.

The peristaltic device 34 includes a rotor 62 having a pair 64, 66 of somewhat cross- or X-shaped end plates non-rotatably joined to each other by a shaft 68. The shaft 68 is journaled 70, 72 for rotation in a pair 74, 76 of end plates with which the housing 50 is provided. Rollers 81-84 are rotatably supported between respective arms 85, 86; 87, 88; 89, 90; 91, 92 of the two cross-shaped end plates 64, 66. The rollers 81-84 push the tubing 54 against the interior sidewall 52 of the housing 50 with sufficient force to evacuate substantially all coating material from the interior of the tubing 54 in the regions 94 where the rollers 81-84 contact it. This results in substantial isolation of slugs of coating material between adjacent contact points 94 of the rollers 81-84 with the tubing 54. The flat configuration of the tubing 54 when it is empty aids to make this isolation possible. Because adjacent slugs of coating material are substantially isolated, minimal current flows between them. Thus, the potential between the device 10 and the target 18 to be coated by coating material dispensed therefrom can be maintained by the electrostatic high potential supply 48, even though the coating material itself is conductive.

The device 34 is driven by a prime mover (not shown), the rotation rate of which is controlled to insure delivery of coating material at a desired flow rate and coating material dispensing rate to device 10.

Figure 4:
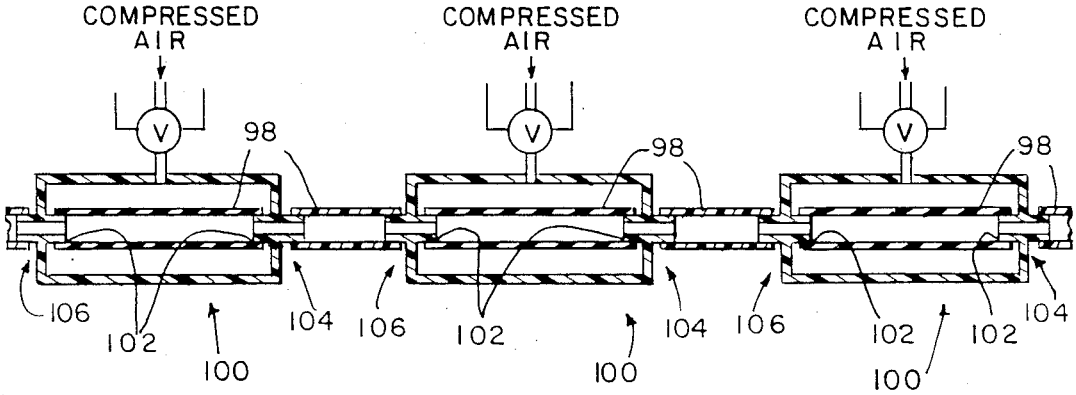
FIG. 4 illustrates a diagrammatic fragmentary longitudinal sectional view of an alternative to the structure of FIGS. 2-3.

In another embodiment of the peristaltic device illustrated in FIG. 4, a flexible, resilient, elastic conduit 98 is provided along its length with pressure boxes 100. Seals 102 are provided between the inlet 104 and outlet 106 ends of the pressure boxes 100 and the conduit 98. A distribution system (not shown) is provided for the peristaltic pressurization of the pressure boxes 100 to segregate the coating material moving along the conduit 98 into slugs.

In another embodiment of the invention, illustrated in FIGS. 5–8, a peristaltic device 120 includes a central right circular cylindrical mandrel 122 surrounded by a relatively rotatable framework 124 which somewhat defines a cylinder which is coaxial with mandrel 122 but is relatively rotatable with respect thereto. Framework 124 rotatably supports four rollers 126 at ninety degree intervals about the axis of mandrel 122 and framework 124. Framework 124 supports rollers 126 in closely spaced relation to the right circular cylindrical outer surface 130 of mandrel 122. Device 120 also includes a removable, replaceable conduit-providing cartridge 132. Cartridge 132 includes a generally right circular cylindrical reinforced flexible resilient core 134 on the outer surface 136 of which multiple turns 138 of a helically oriented circular cross section conduit 140 are provided. The cartridge 132 is slightly elastic and stretchable to aid in its installation onto and removal from the mandrel 122. The framework, with its relatively rotatably mounted rollers 126 then slips over cartridge 132 compressing the regions 142 of conduit 140 in contact with rollers 126 as it goes. The sidewall of conduit 140 is compressed substantially into contact with itself in these regions 142, so that when a coating material is being pumped through the conduit 140 the coating material is effectively divided into discrete slugs, substantially blocking the voltage maintained on a dispensing device coupled to the output end 146 of conduit 140 from a grounded coating material supply coupled to the input end 148 of conduit 140. A ring gear (not shown) can be formed on framework 124 for engagement by a gear of a motor to divide the coating material being supplied through device 120 into discrete slugs. Framework 124 can be split, for example, diametrically into two portions which are hinged together to assist in placing framework 124 over the cartridge 132 mounted on mandrel 122.

Figure 9:
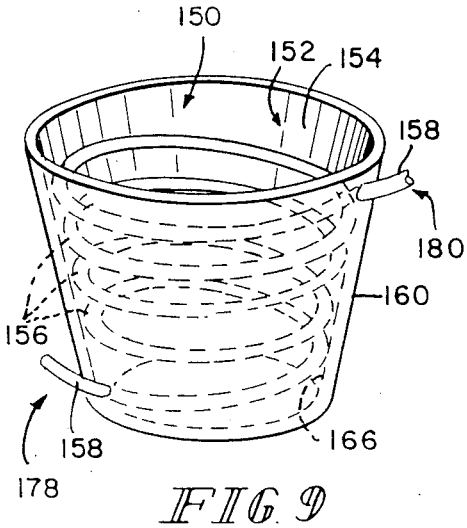
FIG. 9 illustrates a partly longitudinal sectional perspective view of certain details of another system constructed according to the present invention.
Figure 10:
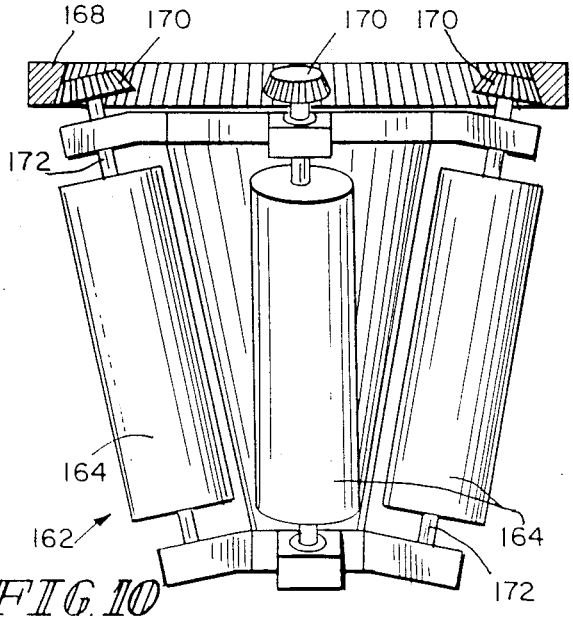
FIG. 10 illustrates a partly fragmentary side elevational view of certain details of the embodiment of the invention, details of which are illustrated in FIG. 9.

In another embodiment of the invention, illustrated in FIGS. 9–10, the mounting of the rollers in tight-fitting contact with the conduit is dealt with in another way. The cartridge 150 in this embodiment is formed from a generally frustoconically shaped reinforced flexible resilient core 152 on the inner surface 154 of which multiple turns 156 of circular cross section conduit 158 are provided. This cartridge 150 easily slips into a frustoconically tapered housing 160. A rotor 162 rotatably supports four rollers 164. The rotational axis of rotor 162 makes the same angle with the rotational axes of rollers 164 as the sidewall 166 of housing 160 makes with its axis. Housing 160 includes a bevelled ring gear 168 at its larger open end. Rollers 164 have bevelled planetary gears 170 provided on their respective shafts 172. The bevels of ring and planetary gears 168, 170, respectively, permit their engagement when rotor 162 is slipped into housing 160 and loaded into conduit 158-compressing engagement with cartridge 150. End caps (not shown) of housing 160 rotatably support and retain rotor 162 in housing 160. The sidewall of conduit 158 is compressed substantially into contact with itself in regions thereof in contact with rollers 164, so that when a coating material is moving through conduit 158 the coating material is effectively divided into discrete slugs, substantially blocking the voltage maintained on a dispensing device coupled to the output end 178 of conduit 158 from a grounded coating material supply coupled to the input end 180 of conduit 158.

Figure 11:
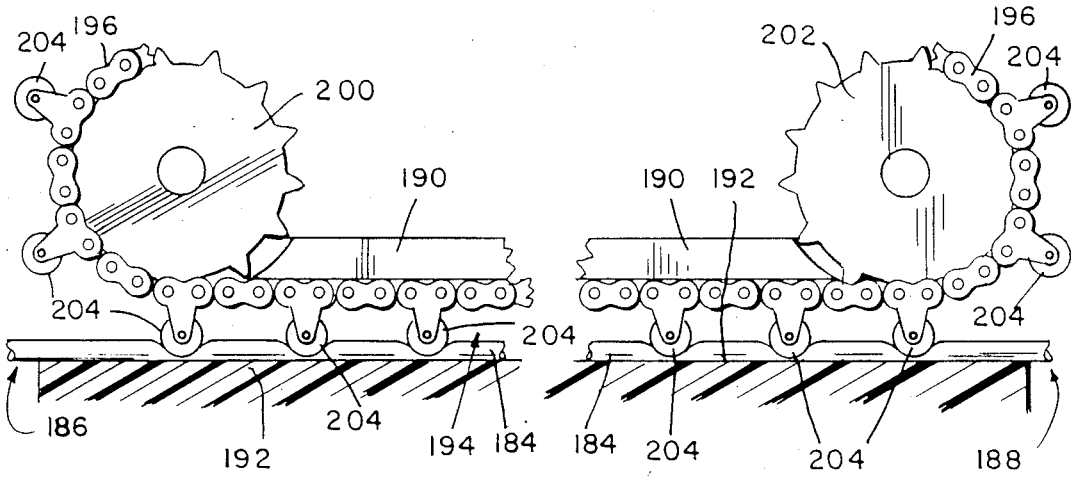
FIG. 11 illustrates a fragmentary sectional side elevational view of another system constructed according to the present invention.
Figure 5:
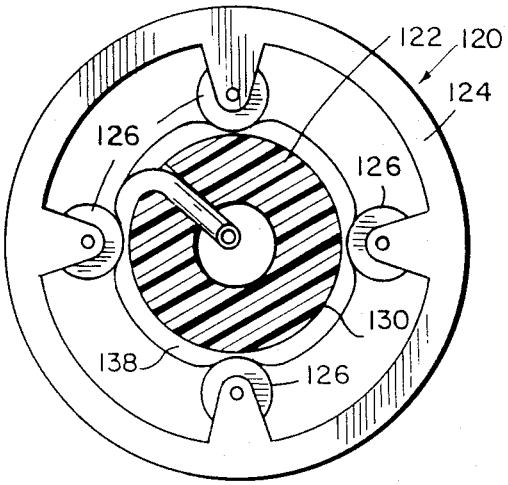
FIG. 5 illustrates a sectional end view of another system constructed according to the present invention.
Figure 6:
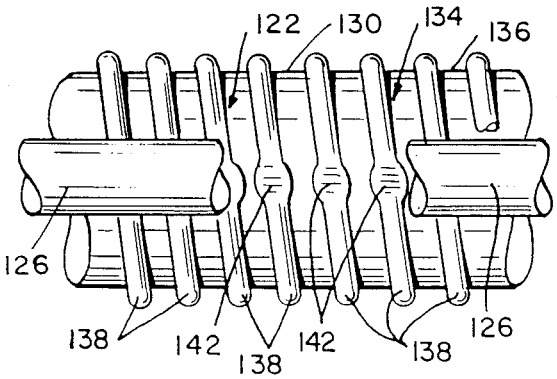
FIG. 6 illustrates a diagrammatic and fragmentary side elevational view of the system illustrated in FIG. 5.
Figure 7:
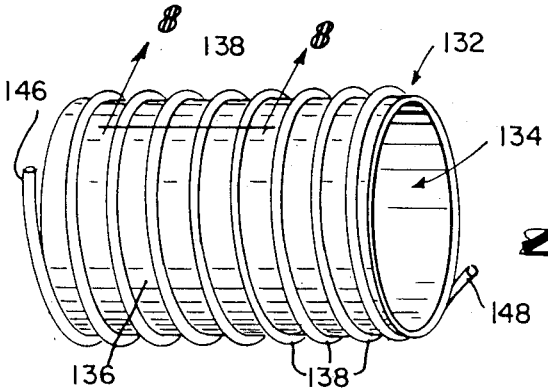
FIG. 7 illustrates a perspective view of an alternative detail of the system illustrated in FIGS. 5-6.
Figure 8:
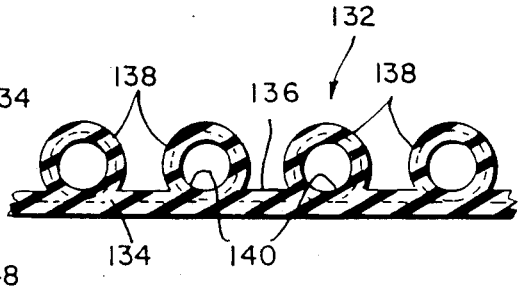
FIG. 8 illustrates an enlarged fragmentary sectional view of a portion of the detail of FIG. 7, taken generally along section lines 8—8 of FIG. 7.

In another linear embodiment of the invention, illustrated in FIG. 11, a circular cross section conduit 184 has an input end 186 coupled to a grounded coating material supply and an output end 188 coupled to a dispensing device maintained at high electrostatic potential. Conduit 184 extends between upper 190 and lower 192 pressure pads between its input and output ends 186, 188, respectively. One run 194 of a roller chain 196 also extends between upper and lower pressure pads 190, 192. Roller chain 196 is trained about chain 196-driving and -driven sprockets 200, 202 rotatably mounted adjacent the input and output ends 186, 188, respectively, of conduit 184. Alternate links of roller chain 196 rotatably support rollers 204 which contact conduit 184 when the links are between pressure pads 190, 192. The spacing between pads 190 and 192 is such that rollers 204 compress the sidewall of conduit 184 substantially into contact with itself in the regions of contact of rollers 204 with conduit 184. When coating material is moving through conduit 184, the coating material is effectively divided into discrete slugs, substantially blocking the voltage maintained on a dispensing device coupled to the output end 188 of conduit 184 from a grounded coating material supply coupled to the input end 186 of conduit 184.

One problem with systems of the types described in FIGS. 2–3 and 5–10 is that there is an axial component of the helical or spiral wound flexible conduit of those systems. When the conduits are subjected to occlusion by rollers which contact them at the relatively high pressures necessary to achieve such occlusion, and rotation of the rollers by rotation of the rotor or armature in which they are mounted, the conduit experiences thrust. This thrust tends to stretch or push out the conduit toward the output end of the voltage block housing. In certain circumstances, this may result in premature fatigue of the conduit or in displacement of the conduit from its designed orientation.

Another characteristic of the embodiments of all of FIGS. 2–11 relates to how quickly the kind of coating material being dispensed through them can be changed. In all of these embodiments, the solvent for the last coating material to be dispensed, hereinafter the pre-change coating material, can be started as slugs divided by the rollers immediately behind the last slug of the pre-change coating material. A roller divides the last slug of the pre-change coating material from the solvent, e.g., water. However, the solvent can only work its way through the peristaltic voltage block at the fastest rate at which the block can deliver any fluid in the conduit. In many circumstances, higher rates of solvent flushing may be desired. Since during the solvent flushing cycle, no dispensing of coating material may be occurring, the high magnitude electrostatic potential to the dispensing device can be switched off during the solvent flushing cycle. This means that during the solvent flushing cycle, no voltage blocking capability may be required.

The embodiments of FIGS. 12–15 are presented to address the possibility that thrust on helically oriented conduit may result in conduit run-out from the voltage block, and to take advantage of the recognition that during a solvent flushing cycle, voltage blocking capability may not even be necessary. These embodiments aVoid the possibility of conduit run-out to a great extent. In addition, they permit a more rapid solvent flush and drying in preparation for a change in the coating material being dispensed.

Figure 12:
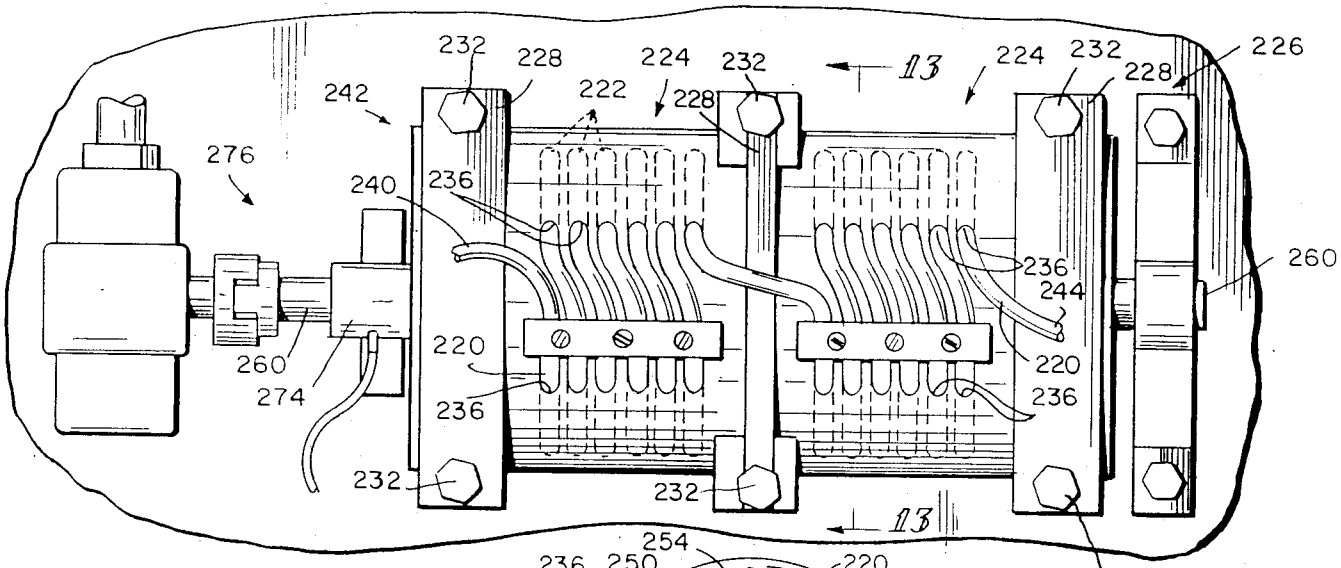
FIG. 12 illustrates a top plan view of another embodiment of the invention.
Figure 13:
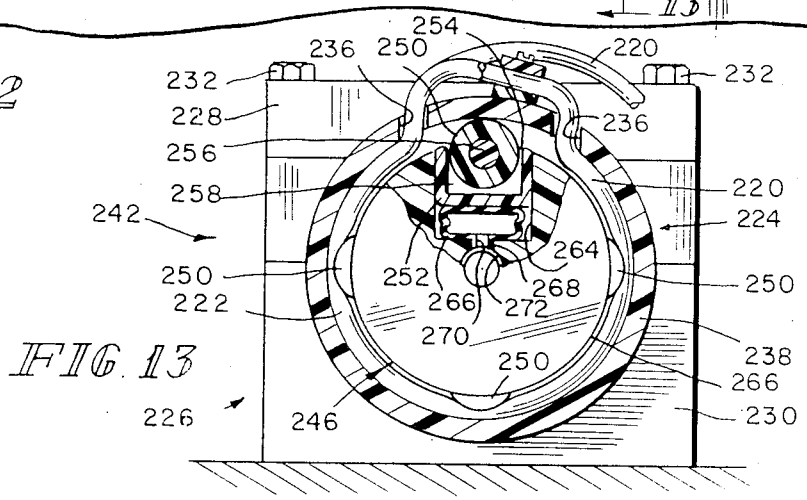
FIG. 13 illustrates a partly broken away partial sectional view, taken generally along section lines 13—13, of the embodiment of FIG. 12.

In the embodiment of the invention illustrated in FIGS. 12–13, the conduit 220 lies in planar loops 222 around the interiors of two right circular cylindrical housing cartridges 224. Cartridges 224 lie adjacent each other in end-to-end axial alignment and are held in this orientation by a framework 226 including caps 228 mounted to a block 230 by cap bolts 232. The flat loops 222 are uniformly spaced axially along cartridges 224 and each loop 222 is substantially perpendicular to the axis of its respective cartridge 224. This orientation means that the conduit 220 will experience substantially no axial thrust along the axis of cartridges 224. This thrust, as previously discussed, would tend to push the conduit 220 out of cartridges 224. This thrust is avoided in the embodiment of FIGS. 12–13. The transfer of the largely separated slugs of coating material from one loop 222 to the next adjacent loop is achieved by threading the conduit 220 through passageways 236 provided in the sidewalls 238 of cartridges 224. The transfer of coating material from each loop 222 to the next adjacent loop 222 as the coating material flows from the inlet end 240 of device 242 to the outlet end 244 thereof takes place outside of the cartridge 224 sidewalls 238.

The rotor 246 construction illustrated in FIG. 13 is provided to speed solvent flushing of coating material from the device 242. The rollers 250 which actually contact the conduit 220 to separate the coating material in the conduit 220 into discrete slugs are rotatably mounted in elongated rectangular prism-shaped cradles 252. One long side 254 of each cradle 252 is open to receive its respective roller 250. The axles 256 of rollers 250 are rotatably mounted in the opposed short end walls 258 of cradles 252. The rotor 246 is provided with four equally spaced longitudinally extending slots 264 (only one of which is illustrated) in its outer generally right circular cylindrical sidewall 266. Slots 264 are slightly larger in length and width than cradles 252. This permits the cradles 252 to be mounted in respective slots 264 for relatively free sliding movement radially of the axle 260 of rotor 246. Each slot 264 is fitted with an inflatable, somewhat rectangular prism-shaped elastomeric reservoir or bag 266 which is positioned at the bottom of the slot 264 before the slot 264 is fitted with a respective cradle 252. Each bag 266 has a nipple 268 which fits into a port 270 in the bottom of the slot 264 to couple the bag 266 to a gallery 272 through which compressed air is provided from a rotary air coupler 274 at the ground potential, or driven, end 276 of device 242.

When it is desired to employ the voltage blocking capacity of device 242, such as when an electrically highly conductive coating material is being supplied therethrough to a coating material atomizing and dispensing device maintained at high-magnitude electrostatic potential, compressed air supplied through coupler 274 and gallery 272 inflates bags 266, forcing the rollers 250 outward and occluding conduit 220 between adjacent slugs of the conductive coating material. Rotation of rotor 246 then moves the slugs along conduit 220 peristaltically from inlet end 240 to outlet end 244 while maintaining a potential difference across ends 240, 244 substantially equal to the potential difference across the output terminals of the high-magnitude electrostatic potential supply.

When it is desired not to employ the voltage blocking capacity of device 242, such as when dispensing of an electrically conductive coating material is complete and the high-magnitude potential supply has been disconnected from the dispensing device in preparation for solvent flushing prior to a subsequent dispensing cycle with a different coating material, the compressed air source is disconnected from coupler 274 and the coupler is vented to atmosphere. The resiliency of conduit 220 and the pressure of the solvent in conduit 220 urge rollers 250 and their respective cradles 252 radially inwardly, permitting the free, rapid flow of solvent through conduit 220 to flush any remaining traces of the pre-change coating material from it. Compressed air can then be passed through conduit 220 to dry it in preparation for the next dispensing cycle.

The voltage blocking capacity of device 242 is proportional to the electrical conductivity of the fluid being supplied through conduit 220, the completeness of the occlusions between adjacent slugs, and the number of such occlusions. As a result, where higher magnitude electrostatic potentials are to be used, additional occlusions can be provided to insure that the voltage blocking capacity of device 242 will not be exceeded. One way to do this is to add more cartridges 224 to the device 242. However, this may not be desirable since the conduit 220, rotor 246 and framework 226 can become quite long. Increasing the length of conduit 220 may increase the length of time required to clean pre-change coating material from it. It may also increase the waste of pre-change coating material and solvent during the cleaning cycle. Increasing the lengths of rotor 246 and framework 226 may needlessly increase the complexity of device 242.

Another way to increase the voltage blocking capacity of device 242 would be to increase the number of rollers 250 carried by rotor 246. Each roller 250 which is added increases by the number of loops 222 the available number of occlusions. The problem, which can best be appreciated by referring to FIG. 13, is that the designer quite quickly runs out of room inside rotor 246 for more slots 264 for accommodating more roller 250—supporting cradles 252.

Figure 14:
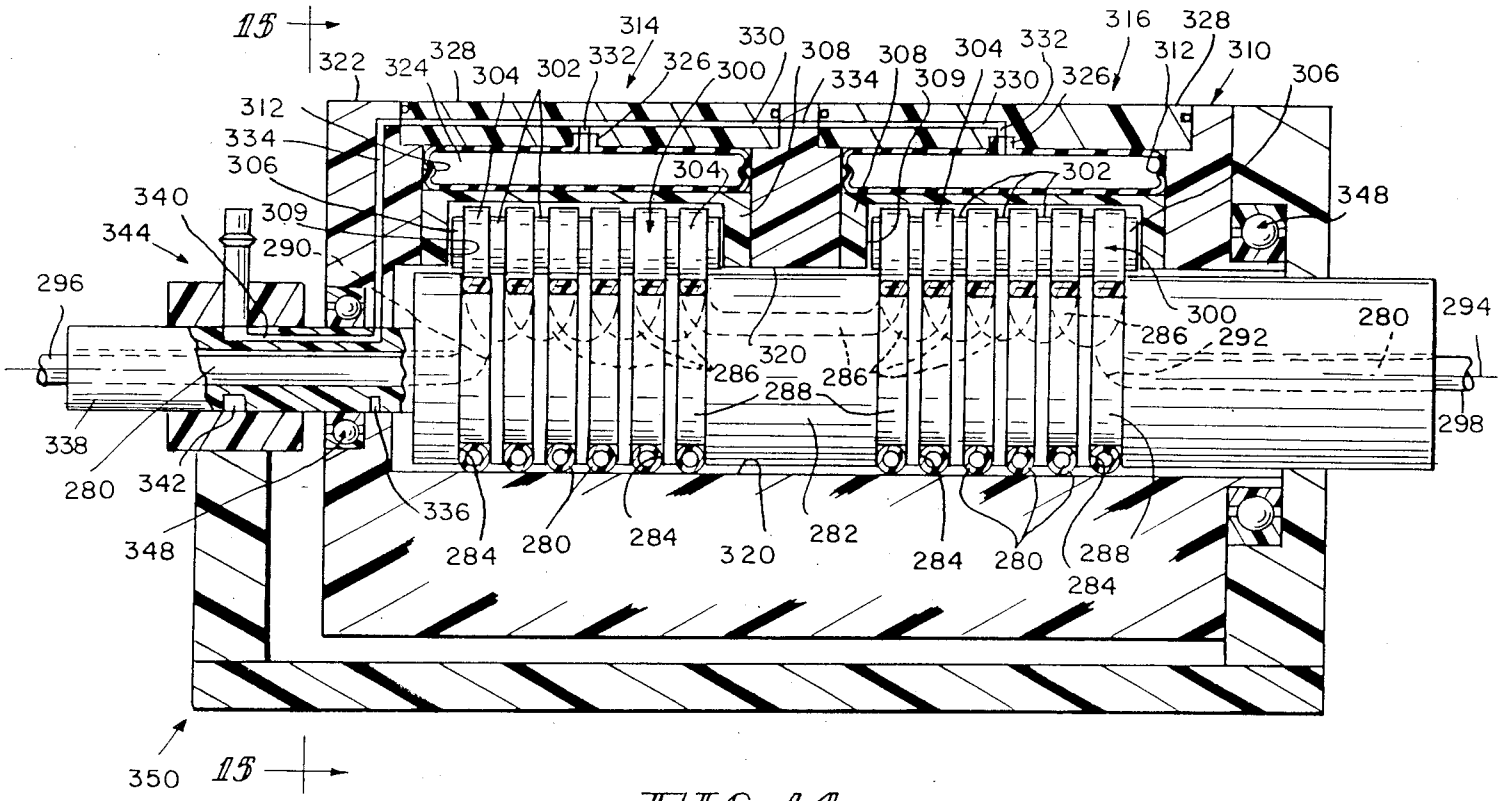
FIG. 14 illustrates a party longitudinally sectional side elevational view of another embodiment of the invention.
Figure 15:
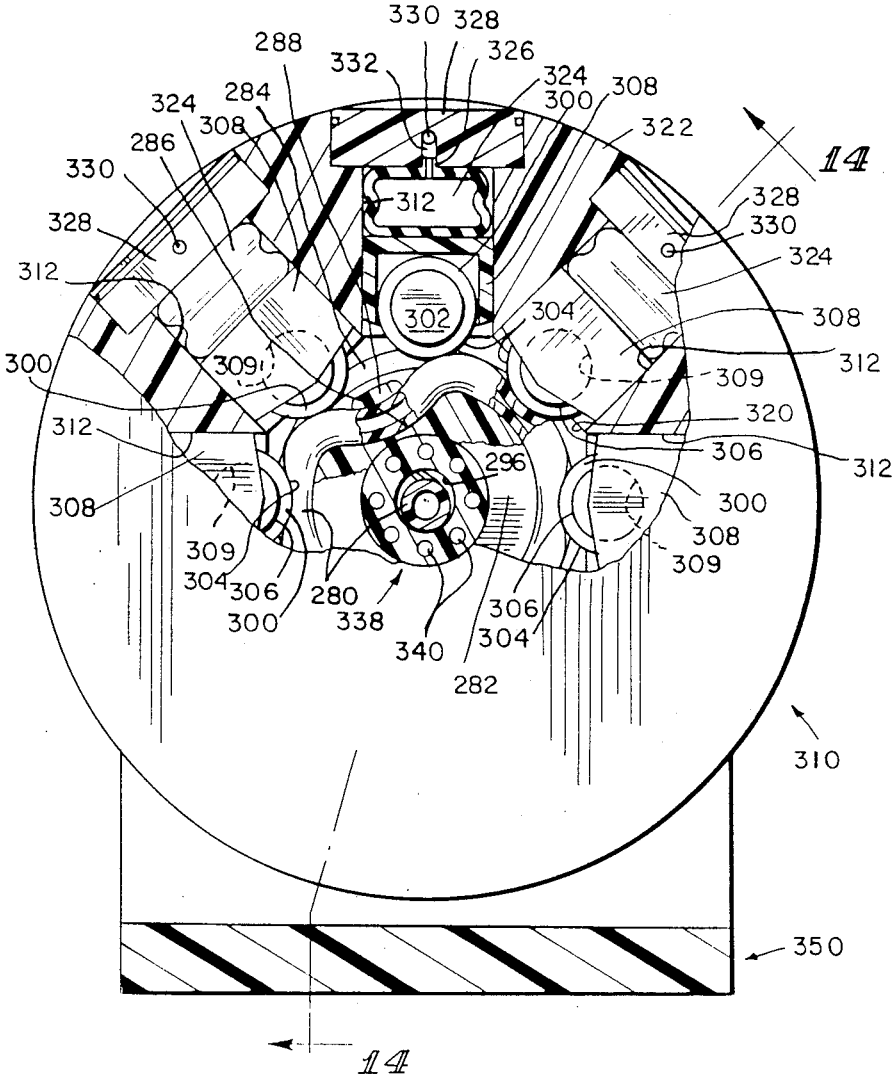
FIG. 15 illustrates a partly broken away partial sectional end elevational view, taken generally along section lines 15—15, of the embodiment of FIG. 14.

The embodiment of the invention illustrated in FIGS. 14–15 addresses this problem. In the embodiment of FIGS. 14–15, the conduit 280 is threaded on and through a mandrel 282. Mandrel 282 is generally right circular cylindrical in configuration, but is provided with transversely extending channels 284. A passageway 286 extends within the interior of mandrel 282 between the floors 288 of each adjacent pair of channels 284. Conduit 280 is wrapped into a loop in a channel 284 adjacent an end of the mandrel, passed through the passageway 286 between the floor 288 of that channel and the floor 288 of the next adjacent channel 284, wrapped into a loop in that channel 284, and so on until the channel 284 at the opposite end of the mandrel 282 is reached. Separate passageways 290, 292 are provided between the floors 288 of the end channels 284 and the axis 294 of the mandrel 282. The inlet 296 and outlet 298 ends of conduit 280 are last threaded through passageways 290, 292, respectively and out of mandrel 282 along the axis thereof in opposite directions.

The rollers 300 in this embodiment are divided by clearance regions 302 into contacting segments 304 which contact conduit 280 in respective channels 284. Each roller 300 (in the embodiment of FIGS. 14–15 there are sixteen such rollers 300) is rotatably mounted by its axle 306 in a respective cradle 308. Cradles 308 are generally right rectangular prism-shaped. Their short end walls include reliefs 309 for rotatably receiving respective rollers 300. Rotor 310 is provided with eight equally spaced longitudinally extending slots 312 in each of two axially spaced sections 314, 316 of rotor 310. Each slot 312 extends radially of the mandrel 282 axis between the inner sidewall 320 of the rotor 310 and the outer, generally right circular cylindrical sidewall 322 thereof. The rotor 310 fits with clearance over the mandrel 282. Then the cradles 308 with their respective rollers 300 rotatably mounted in them are loaded into the slots 312 through the slot 312 openings in sidewall 322. Elastomeric reservoirs or bags 324 are then loaded into slots 312 with the bag 324 nipples 326 pointing radially outward. Finally slot-closing caps 328 with internal compressed air-providing galleries 330 and compressed air supplying openings 332 close the outer ends of slots 312. Galleries 330 are connected to galleries 334 provided in rotor 310. Galleries 330, 334 are supplied with compressed air to inflate bags 324 and divide fluid in conduit 280 into slugs, or vented to atmosphere to permit the free flow of fluid through conduit 280 by an annular relief 336 around an elongated right circular cylindrical shaft 338 formed on the input end of mandrel 282, eight longitudinally extending galleries 340 equally spaced around inlet end 296 of conduit 280 along shaft 338 and an annular relief 342 around shaft 338 inside of an air coupler 344. Suitable bearings 348 rotatably mount rotor 310 from the supporting framework 350 and shaft 338.

What is claimed is:

1. A coating material dispensing system comprising an electrostatic high potential supply having an output terminal on which the supply maintains a high electrostatic potential, a source of coating material, a dispenser for dispensing the coating material, means for coupling the dispenser to the source of coating material, means for coupling the output terminal to the dispenser to supply potential to the coating material dispensed by the dispenser, and means for providing a flow of coating material from the source to the dispenser, the means for coupling the dispenser to the source of coating material including a device for substantially dividing the coating material being delivered to the dispenser at any given time into a plurality of discrete slugs of coating material substantially to interrupt the electrical path through the coating material from the terminal to the coating material supply.

2. The system of claim 1 wherein the device comprises a peristaltic device.

3. The system of claim 2 wherein the peristaltic device comprises a length of resilient conduit having an inlet end and an outlet end for coupling between the source of coating material and the dispenser, a housing having an interior wall against which the resilient conduit lies, a rotor, means for rotatably mounting the rotor within the housing, the rotor supporting means for contacting the resilient conduit, the contacting means compressing the resilient conduit at a plurality of locations against the interior wall of the housing substantially to separate the coating material carried thereby at any given time into the plurality of discrete slugs.

4. The system of claim 3 wherein the interior wall is generally right circular cylindrical in configuration and the length of resilient conduit is formed into somewhat of a helix around the interior wall.

5. The system of claim 4 wherein the resilient conduit is generally flat when it is empty.

6. The system of claim 3 wherein the interior wall is generally frustoconical in configuration and the length of resilient conduit is formed somewhat into a spiral wrapped around the interior wall.

7. The system of claim 2 wherein the peristaltic device comprises a length of resilient conduit having an inlet end and an outlet end for coupling between the source of coating material and the dispenser, a mandrel having an exterior wall against which the resilient conduit lies, a rotor, means for rotatably mounting the rotor to surround the mandrel, the rotor supporting means for contacting the resilient conduit, the contacting means compressing the resilient conduit at a plurality of locations against the exterior wall of the mandrel substantially to separate the coating material carried thereby at any given time into the plurality of discrete slugs.

8. The system of claim 7 wherein the exterior wall is generally right circular cylindrical in configuration and the length of resilient conduit is formed into somewhat of a helix around the exterior wall.

9. A peristaltic voltage block comprising a resilient, electrically non-conductive conduit, first means for supporting multiple loops of the conduit, a rotor for supporting contactors for contacting the conduit, and second means for supporting the rotor for rotation with the contactors in contact with the conduit for occluding the conduit at multiple contact points to divide an electrically non-insulative fluid in the conduit into slugs separated by respective ones of the occlusions to minimize current flow through the fluid between the ends of the conduit, the first means comprising means for supporting the loops of conduit in substantially parallel planes with lengths of conduit extending between adjacent planes to connect adjacent loops of conduit to each other.

10. The apparatus of claim 9 wherein the rotor is positioned radially outwardly from the outside surface.

11. The apparatus of claim 10 wherein the contactors comprise rollers, and means for supporting the rollers for rotation in contact with the conduit.

12. The apparatus of claim 11 wherein the rotor further comprises means for selectively forcing the rollers to occlude the conduit.

13. The apparatus of claim 9 wherein the first means comprises a housing having a cylindrical inside surface including means defining passageways extending through the cylindrical inside surface for accommodating the lengths of conduit which extend between adjacent planes.

14. The apparatus of claim 9 wherein the rotor is positioned radially inwardly from the inside surface.

15. The apparatus of claim 14 wherein the contactors comprise rollers, and means for supporting the rollers for rotation in contact with the conduit.

16. The apparatus of claim 15 wherein the rotor further comprises means for selectively forcing the rollers to occlude the conduit.

17. A peristaltic voltage block comprising a resilient, electrically non-conductive conduit, first means for supporting multiple loops of the conduit, a rotor for supporting contactors for contacting the conduit, and second means for supporting the rotor for rotation with the contactors in contact with the conduit for occluding the conduit at multiple contact points to divide an electrically non-insulative fluid in the conduit into slugs separated by respective ones of the occlusions to minimize current flow through the fluid between the ends of the conduit, the first means comprising means for supporting the loops of conduit in substantially parallel planes with lengths of conduit extending between adjacent planes to connect adjacent loops of conduit to each other, the first means comprising a mandrel having a cylindrical outside surface and including means defining passageways internally of the mandrel for accommodating the lengths of conduit which extend between adjacent planes.

18. The apparatus of claim 17 wherein the mandrel defines an axis and includes channels formed around its outside surface defining the substantially parallel planes.

19. The apparatus of claim 18 wherein the passageways extend between adjacent channels, the adjacent loops of conduit lying in adjacent channels, and the connecting lengths of conduit extending through the passageways between adjacent channels.

20. A peristaltic voltage block comprising a resilient, electrically non-conductive conduit, first means for supporting multiple loops of the conduit, a rotor for supporting contactors for contacting the conduit, and second means for supporting the rotor for rotation with the contactors in contact with the conduit for occluding the conduit at multiple contact points to divide an electrically non-insulative fluid in the conduit into slugs separated by respective ones of the occlusions to minimize current flow through the fluid between the ends of the conduit, the first means comprising means for supporting the loops of conduit in substantially parallel planes with lengths of conduit extending between adjacent planes to connect adjacent loops of conduit to each other, the first means comprising a housing having a cylindrical inside surface including means defining passageways extending through the cylindrical inside surface for accommodating the lengths of conduit which extend between adjacent planes, the housing defining an axis and including channels formed around its inside surface defining the substantially parallel planes.

21. The apparatus of claim 20 wherein the passageways extend between adjacent channels, the adjacent loops of conduit lying in adjacent channels, and the connecting lengths of conduit extending through the passageways between adjacent channels.

* * * * *